US005624326A

United States Patent [19]

Hohl et al.

[11] Patent Number: 5,624,326

[45] Date of Patent: Apr. 29, 1997

[54] PRACTICE PUTTING APPARATUS AND METHOD

[76] Inventors: Thomas H. Hohl, 3824 94th Ave. NE., Bellevue, Wash. 98004; Ronald L. Bidleman, 17522 NE. 142nd. St., Redmond, Wash. 98052

[21] Appl. No.: 621,155

[22] Filed: Mar. 21, 1996

[51] Int. Cl.[6] ..... A63B 69/36

[52] U.S. Cl. ..... 473/176; 473/167; 473/180; 473/172; 473/257; 473/409

[58] Field of Search ..... 473/167, 172, 473/176, 180, 170, 171, 257, 409; 273/DIG. 21

[56] References Cited

U.S. PATENT DOCUMENTS

| | | | |
|---|---|---|---|
| 2,869,875 | 1/1959 | Steenson . | |
| 3,356,370 | 12/1967 | Larsen | 473/172 |
| 4,082,287 | 4/1978 | Berkey . | |
| 4,336,940 | 6/1982 | Sprague | 473/257 X |
| 4,805,912 | 2/1989 | Hickman . | |
| 4,869,510 | 9/1989 | Battersby . | |
| 5,209,484 | 5/1993 | Randall . | |
| 5,273,284 | 12/1993 | Montgomery . | |
| 5,350,177 | 9/1994 | Furbush . | |
| 5,375,833 | 12/1994 | Marier | 473/257 |
| 5,437,446 | 8/1995 | Youngkin | 473/257 X |

*Primary Examiner*—George J. Marlo
*Attorney, Agent, or Firm*—Robert B. Hughes

[57] ABSTRACT

An apparatus and method to enable practicing of a putting stroke on an actual green surface. A putting cup post is positioned upright in the putting cup, and a stabilizing post is put into the green surface so as to be upstanding therefrom adjacent to a putting location. An alignment cord is extended from an upper end of the stabilizing post to the upper end of the putting cup post, and an alignment cord is extended between the two posts. For a breaking putt, an alignment post is positioned to provide an initial alignment section of the cord that is aligned with the initial path of travel of the ball from the putting location along the intended putting path. The ball is placed at a putting location near the stabilizing post, and the golfer uses proper putting techniques to strike the ball, using the initial portion of the alignment cord to putt the ball in the proper direction.

20 Claims, 5 Drawing Sheets

14
78
76
80
84
86
88
90
92
16
12
22

12
14
16
16a
16b
76
86
94
96
100
102
a
b

PRACTICE PUTTING APPARATUS AND METHOD

The present invention relates to an apparatus and method for practicing a putting stroke, and more particularly for practicing the putting on a golf green in a manner that both straight putts and breaking putts can be practiced effectively.

BACKGROUND OF THE INVENTION a. Background Art

In an average game of golf, as many as half of the total strokes (or sometimes more) are often executed with a putter. Over the years, various techniques for that teaching of effective putting have been developed for all classes of golfers, ranging from the beginners all the way to the touring pro. Also, various teaching aids to improve the person's putting stroke have been developed over the years. A search of the U.S. patent literature has disclosed a number of such aids, these being the following:

U.S. Pat. No. 2,869,875 (Steenson) discloses what is called a "golf practice game". This patent provides two "U" shaped wickets, which can be positioned apart from one another, and a cord or string is stretched between the two wickets at a location possibly several inches or a foot above the ground surface. This cord serves as an alignment guide for the person practicing the putt or possibly a short chip shot. This is arranged so that the device can be used both indoors or outdoors. There are pivotally mounted feet at the U shaped members, and mounted to the outer end of each foot is a fork to penetrate the ground or carpet to hold the wicket in an upright position. Also, a flag or prop 12 can be provided between the wickets, and this is used in practicing a chip shot where the ball travels in flight over the flag and then strikes the ground.

U.S. Pat. No. 4,082,287 (Berkey) shows a putting guide where there is a transparent or translucent guide member that is cantilever mounted above the ground to serve as an alignment guide.

U.S. Pat. No. 4,805,913 (Hickman) shows a putting alignment guide in the form of a rectangular piece of artificial turf that is spread over a ground surface. A putting path line 20 is formed lengthwise down the center of the putting surface toward the cup.

U.S. Pat. No. 5,209,484 (Randall) shows a frame where there is a center cord positioned between ends of the frame. This is a teaching tool to instruct the player on the mechanics of-the putting stroke, and this is outlined in column 4, beginning at line 16.

U.S. Pat. No. 5,273,283 (Montgomery) show a putting device that has a pair of guide rods so that the person can align his or her golf swing.

U.S. Pat. No. 4,869,501 (Battersby) shows what is called a "golf instruction apparatus and method". In this device, cords are positioned from posts at various locations and heights. This is more for a physical reference for a full golf swing, rather than provide an alignment path for the putting stroke.

U.S. Pat. No. 5,350,177 (Furbush) shows a frame which can be adjusted to various widths. This also is more of a training device for practicing the full golf swing.

SUMMARY OF THE INVENTION

The method and apparatus of the present invention are particularly adapted for enabling the golfer to use this method and apparatus to improve the putting stroke while actually being on the golf green where there is a putting surface and a putting cup location.

The method comprises first placing a putting cup posts in a position to extend upwardly from the putting cup location.

Then a stabilizing post is positioned on the putting surface at a location spaced from the putting cup location to extend upwardly above the putting surface.

An alignment cord is positioned to extend from the tape stabilizing post to the putting cup post in a manner that the cord is positioned above the putting surface. At least an initial alignment portion of the cord is at a putting location, and is aligned with a target line which coincides with an initial portion of an intended putting line which extends from the putting location to the putting cup location.

The golf ball is placed beneath the cord at the putting location, and the putting stroke is executed to putt the ball from the putting location at least initially along the target line, visually utilizing the initial portion of the cord for alignment of the putting stroke.

In a situation where the putting surface along the intended putting path is horizontally aligned relative to transverse alignment components along the length of the intended putting line, with the intended putting line being a substantially straight putting line, the cord is positioned to extend in a straight line from the putting location to the putting cup location.

Where the putting surface has a lateral slant relative to the intended putting line so that the intended putting line curves from the ball location toward the cup in a direction of downward lateral slants, the cord is aligned so as to have an initial cord portion at the putting location aligned with the intended putting line at the putting location. This is specifically accomplished by positioning an alignment post on the putting surface at a target location positioned laterally of the putting line, and the initial cord portion extends from the putting location toward the alignment post.

Desirably, the alignment post has at an upper portion thereof above the putting surface, an alignment cord engaging portion, and the alignment cord is engaged with the cord engaging portion to properly position the cord above the putting surface.

Also, in the preferred form the alignment cord is initially wound on the stabilizing post at a winding location positioned on the stabilizing post, with the cord extending from the stabilizing post at a predetermined distance above the putting surface to permit adequate vertical spacing for execution of the putting stroke. In a preferred form, the stabilizing post has at an upper end thereof, a notch means to engage the alignment cord so as to retain the alignment cord at a fixed location on the stabilizing post.

Desirably, each of the putting post, stabilizing post and alignment post has a lower mounting portion to position each of said posts at a predetermined height above the putting surface. Each of said posts has at an upper end thereof an alignment cord engaging means. The method further comprises extending the cord from each of the alignment cord engaging means of the three posts so that the alignment cord is at a proper predetermined position above the putting surface. At least one of the stabilizing posts and the alignment posts has at a lower end thereof, a spike means arranged to extend into ground strata at the putting surface.

Another feature of the present invention is providing a target zone accessory means at the putting cup location. This accessory means comprises a planar sheet material having a central portion surrounding the putting cup location and a plurality of radially and outwardly extending arm portions, with ends of each arm portion having putting surface securing means to properly spread the accessory over the putting surface and around the putting location.

In the method of the present invention, where there is lateral slant relative to the intended putting line, the method further comprises:

a. ascertaining a proposed intended putting line, and also a proposed target line which coincides with the initial portion of the proposed intended putting line;

b. positioning an alignment post at a target location spaced from the putting location toward the putting location so that the alignment post is aligned with the intended target line;

c. locating the alignment cord so that the alignment cord extends above the putting surface from the stabilizing post to the alignment post, and from the alignment post to the putting cup post;

d. then executing the putting stroke to putt the ball initially along the target line;

e. in a situation where the ball after the executing of the putting stroke travels along a course out of alignment with the putting cup location, adjusting the position of the alignment post to correct the intended putting line.

As a further feature of the method of the present invention, it comprises further adjusting distance of the alignment post from the putting location so that a portion of the alignment cord extending from the alignment post to the putting cup post has a predetermined alignment relationship with a later portion of the path of travel of the ball. Thus, a person executing the stroke is able to co-relate both an initial alignment portion of the alignment cord and a later portion of the alignment cord with the path of travel of the ball toward the putting cup location.

In another form of the method of the present invention, first and second alignment posts are utilized so that the cord provides three alignment cord sections having a alignment relationship to the intended putting line.

The apparatus of the present invention comprises the three posts, as described above, with the alignment cord. Further, it also comprises the target zone accessory means, as described above.

Other features of the present invention will be apparent from the following detailed description.

DESCRIPTION OF THE PREFERRED EMBODIMENTS

Figure 1:
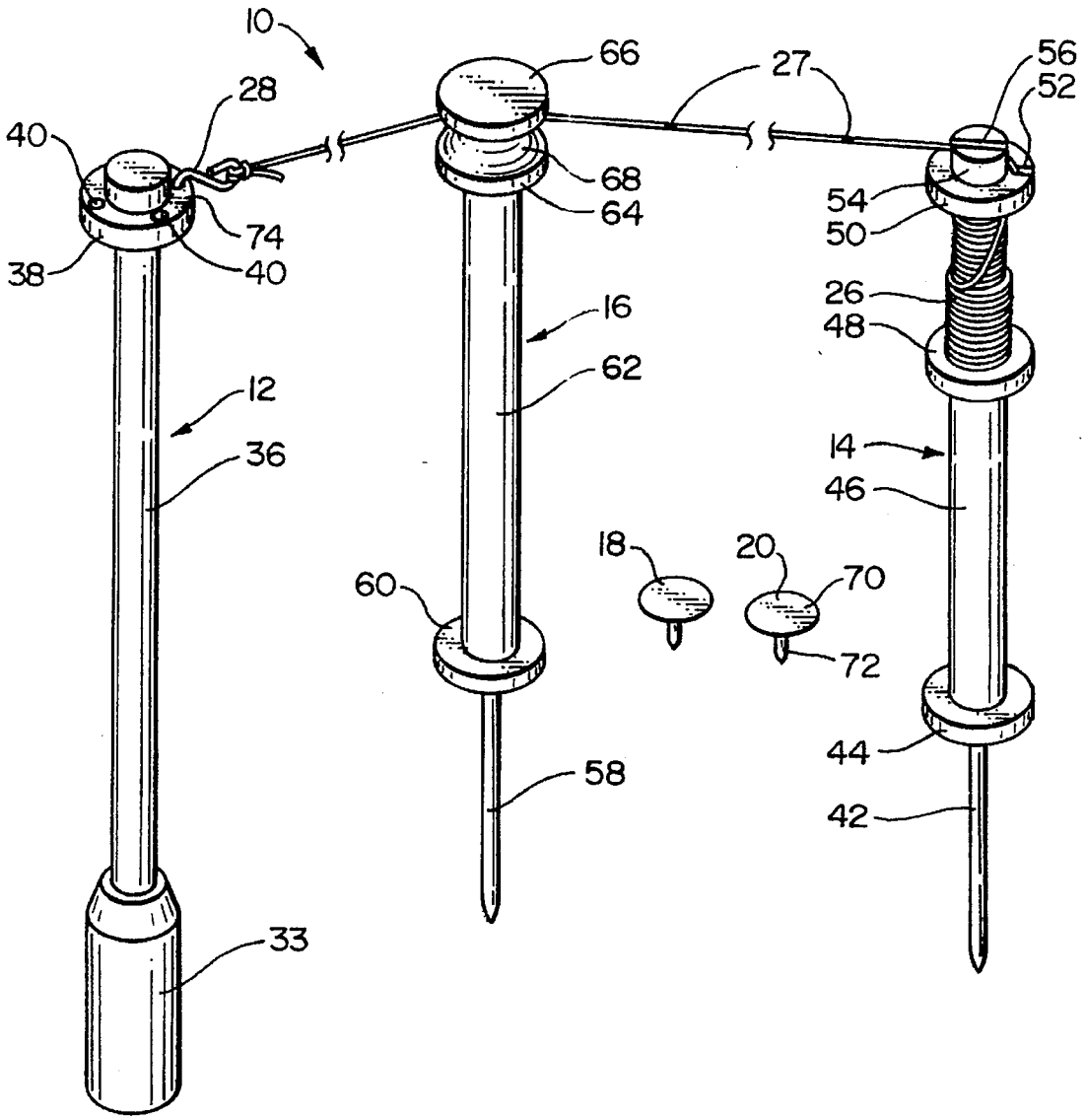
FIG. 1 is an isometric view showing the main components of the apparatus of the present invention.

FIG. 1 illustrates the five main components of the present invention, generally designated 10. This comprises three posts, namely a putting post cup 12, a stabilizing post 14, and a target or alignment post 16. Also, there are two ball markers, namely a rear ball marker 18 and a forward ball marker 20.

There will first be a brief explanation of the function of these main components, this being followed by a more detailed description of each of the components and then a more detailed description of the method of the present invention.

The putting cup post 12 as its name implies, is positioned in the putting cup 22 so as to be upstanding therefrom. The stabilizing post 14 is placed on the surface of the green 24 so as to be upstanding therefrom, and at the top end of the stabilizing post 14 there is wound an optic cord 26. This optic cord 26 has an end hook 28 which is attached to the upper end of the putting cup post 12 so that the cord 26 extends from the upper end of the stabilizing post 14 to the upper end of the putting cup post 12. The cord 26 has a bright color (e.g. yellow), and has black marks 27 at three foot intervals along the length of the cord 26 (i.e. at locations three, six, nine, twelve, and fifteen feet from the end hook 28).

Figure 2:
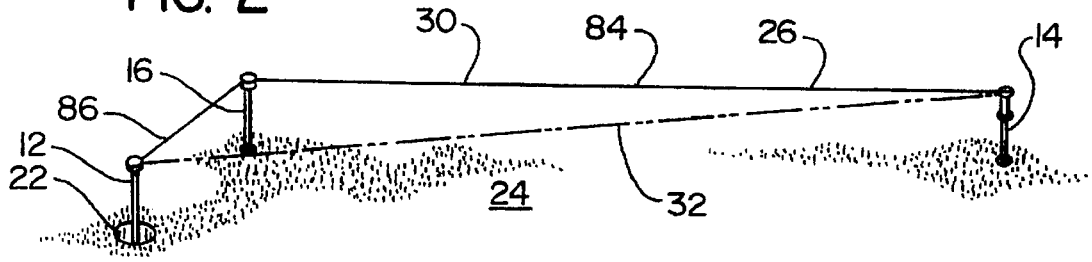
FIG. 2 is an isometric view of the three posts of the present invention being utilized in a typical situation on a golf green.

The alignment post 16 is utilized when the person is practicing a putt on a breaking surface, and this alignment post 16 is positioned to establish a target line or an alignment path extending from the alignment post to the stabilizing post 14. As can be seen in FIG. 2, the three post 12, 14, and 16 are positioned on the green surface 24 in a situation where the green is sloping laterally and downwardly in a general direction from the alignment post 16 toward the putting cup post 12. The optic cord thus has a first alignment component 30 from the post 14 to the post 16 that is angled in an uphill direction from an imaginary line 32 extending from the post 14 to the post 12. When the slope of the green is such that a direct path from the stabilizing posts 14 to the cup 22 has no lateral slant (and hence no break when the ball is putted), the alignment post 16 would normally not be used, and the cord 26 would extend in a straight line directly from the stabilizing post 14 to the putting cup post 12. (See FIG. 3).

Figure 7:
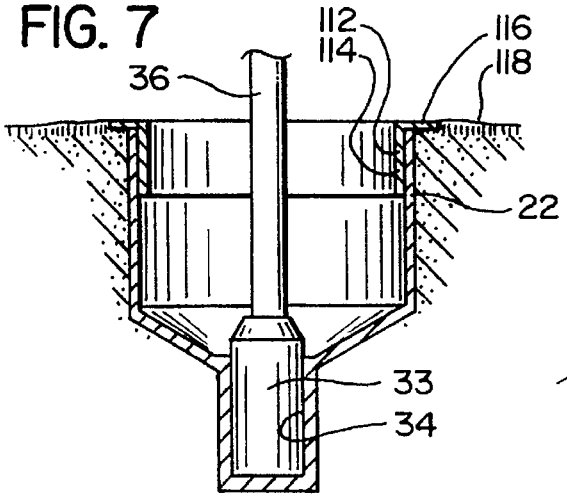
FIG. 7 is a vertical sectional view taken along line 7—7 of FIG. 6, showing the putting cup and the putting cup post of the present invention mounted in the putting cup.
Figure 8:
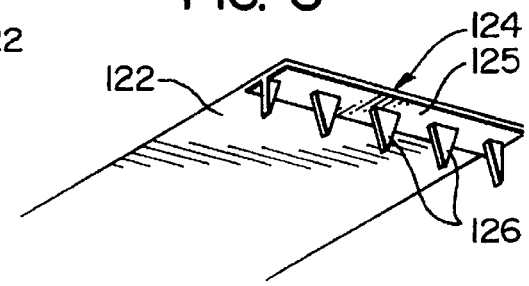
FIG. 8 is an isometric view showing the bottom end portion of one of the aerial locating arms of the area locating member shown in FIG. 6.

To proceed now to a more detailed description of the apparatus 10, the putting cup post 12 comprises a cylindrical base portion 33 which has a diameter such that it fits snugly within a bottom socket 34 located at the bottom of the cup 22, this socket 34 serving the usual function of engaging the lower end of the flag pole (see FIG. 7). Extending upwardly from the base portion 33 is a main post portion 36 that extends upwardly to a height of about 6 inches above the green surface 24. At the top of the main post portion 36, there is an annular flange 38 having four holes 40 formed therein to receive the aforementioned hook at the end of the cord 26.

The stabilizing post 14 comprises a lower cylindrical spike or probe 42 which has a lower pointed end and sufficiently small diameter so that it can be stuck into the ground below the green surface 24. Immediately above the probe 42 Is an annular flange 44 of sufficient diameter to provide adequate bearing surface against the green surface 24 to stabilize the post 14 in its upright position. The post 14 further comprises a main post portion 46 which extends upwardly from the flange 44, and has at its upper end a pair of vertically spaced annular flanges 48 and 50 which define therebetween with the upper part of the post 46 a spool around which is wound the optic cord 26.

The upper flange 50 has a pair of circumferentially spaced, radially extending notches 52 to receive the cord 26. Also, the upper end of the main post portion 46 extends upwardly at 54 a short distance above the upper flange 50 and has a diametrically aligned upper slot 56 to receive the cord 26. Thus, a desired length of cord can be unwound from the upper end of the stabilizing post 14, and when the desired amount of cord has been unwound, the cord can be securely positioned in one or more of the notches 52 and in the slot 56 to properly position the portion of the cord adjacent to the post 14 at its desired location at the top of the stabilizing post 14.

The alignment post 16, like the stabilizing post 14, has at its slower end a spike or probe 58, above which is a stabilizing flange 60, this enabling the alignment post 16 to be positioned on the green surface 24 by inserting the probe 68 into the ground, with the flange stabilizing the post 16 in its upright position. The post 16 has a main post portion 62 extending upwardly, and at its upper end there are a pair of vertically spaced flanges 64 and 66, spaced about a half an inch from each other so as to provide a rounded circumferential recess 68 to receive the cord 26. The cord 26 could simply be passed around an arcuate portion of the slot 68, or (if the cord 26 is to be held more securely) it could be wrapped one or more times around the slot 68.

The two ball markers 18 and 20 can be of conventional design, so that these would comprise a circular flat disk portion 70, and also a short downwardly extending probe 72 to be inserted into the ground below the green surface 24.

The overall height dimension of the putting cup post 12 is a little over ten and one half inches, and the upper surface of the upper flange 38 is about ten and one half inches above the bottom surface of the base portion 32 of the putting cup post 12. This post 12 is sized so that when it is in place in the cup 22, as shown in FIG. 7, the upper surface 74 of that flange 26 is about six to six and one half inches above the metal of the green surface 24.

The distance from the bottom surface of the lower stabilizing flange 44 of the stabilizing post 14 to the lower surface of the upper diametrically aligned slot 56 is approximately six and one half inches. Likewise, the distance from the lower surface of the lower stabilizing flange 60 of the alignment post 16 to the middle of the upper circumferential slot 68 is between six and six and one half inches. Thus, when the cord 26 is extended so that it reaches from the top of the stabilizing post 14 around the upper recess 68 Of the alignment post 16 to hook on to the upper flange 44 of the putting cup post 12, the cord 24 is about six to six and one half inches above the surface 24 of the putting green.

It is believed that a better appreciation of the present invention will be obtained by first discussing generally some of the most significant goals and advantages of the present invention, prior to a more detailed description of a method of the present invention. First and fundamentally, the present invention enables the user to more effectively practice the basic putting fundamentals. (The originators have categorized these as ten putting fundamentals, and these will be discussed later herein). Another advantage of the present invention is that it is designed to be used on actual putting greens, and not on an artificial surface. This makes the transition from putting with the apparatus of the present invention as part of the practice routine, to the actual putting in a golf game (or in golf practice without the present invention), more easy to accomplish. A third advantage of the present invention is that the overall apparatus is light, compact, relatively simple, and capable of fitting in most any golf bag. A related advantage is that it can be easily and quickly set up on most any putting green and also easy to store after the practice session.

The process of developing the present invention has demonstrated that it has the general capability of consistently improving the putting skills of the users. More specifically (and particularly in using the present invention to master breaking putts), the present invention can function effectively as an analytical learning tool where the user can more effectively master the techniques of understanding the dynamics of the travel of the ball over a slanting putting surface. In this regard, it helps the user form more accurate mental images of the path of the golf ball when it is traveling its course on a breaking putt. This also will be discussed more completely later herein.

Finally, it has been found by the originators during the development of the present invention that these goals can be accomplished with the present invention in a manner that the practice session can be not only relatively easy, but, also an interesting and enjoyable experience.

To describe the method of the present invention, we will proceed through what would be a typical practice session using the apparatus and system of the present invention.

A logical starting place is to select a location on a golf green where the path from the location of the ball to the putting cup is horizontal with no lateral slant, or possibly a path with a moderate uphill slope toward the cup, again with no lateral slant, so that there would be no break to one side or the other.

Figure 3:
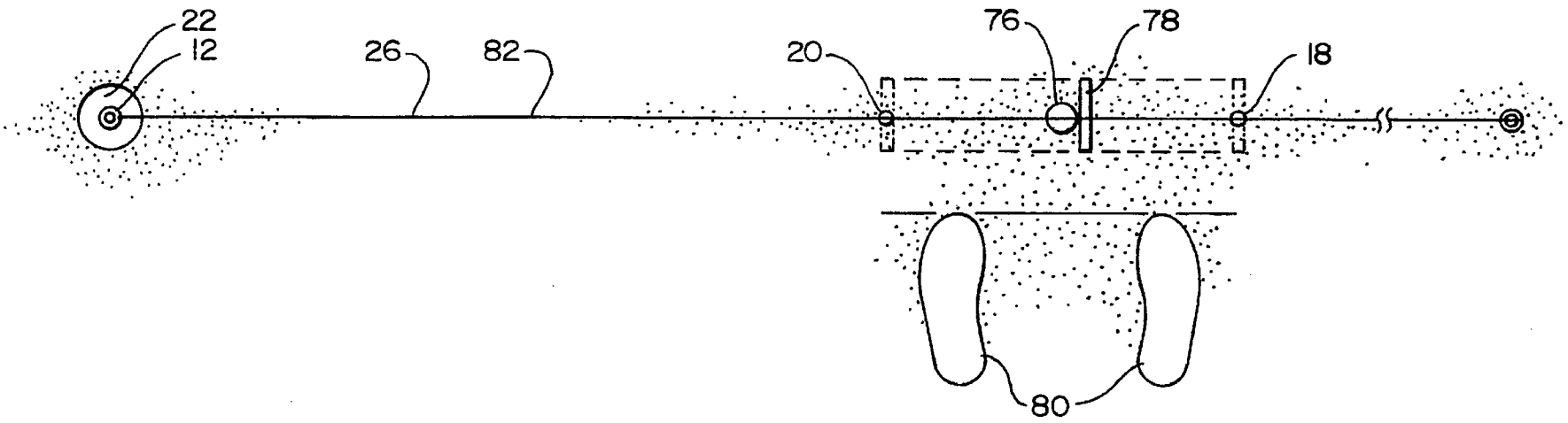
FIG. 3 is a top plan view illustrating the present invention being utilized in practicing a putting stroke where the putting line is a straight line from the putting location to the putting cup.

First, as shown in FIG. 3, the putting cup post 12 is placed in the cup 22, as shown in FIG. 7. The hook 28 on the end of the optic cord 26 is attached to one of the holes 40 in the top flange 38 of the putting cup post 12, and the cord 26 is unwound from the stabilizing post 14 to its full length. The stabilizing post 14 is then placed above the green surface 24 so that the cord 26 is aligned over the intended putting path to the cup 22, and the probe 42 is pushed into the ground.

Initially the ball 76 is placed at a putting location beneath the cord 26 a relatively short distance from the cup 22 (a three foot distance to be under the first black mark 27 would be appropriate). Then the person assumes the proper putting stance alongside the ball, and places the head 78 of the putter behind the ball. (For convenience of illustration, only the head 78 of the putter is shown in FIG. 3.) Also, the foot locations 80 are shown also in FIG. 3.

Then the person executes (as well as possible) the proper putting stroke to send the ball along the intended path 82 toward the cup 22. After executing this putting stroke several times, the person places the rear ball marker 18 at the end location of the back stroke, and the forward ball marker 20 an equal distance forward of the putting location. Thereafter, the person executes the putting stroke by moving the club head 78 from the rear marker 18 through the location of the ball 76, ending the stroke at the forward marker 20. Three such putts are executed. There are a number of components that make up the proper putting stroke, and also several recommended exercises to improve the putting stoke, and these will be discussed later in this text.

After several three foot putts are made, the ball is moved back to the six foot location beneath the cord 26, and the same process is repeated. This same process is further repeated at the nine foot, twelve foot and fifteen foot locations.

In executing the putting stroke, the ball 76 should initially be placed directly below the selected black spot on the cord 26. Then, for a right handed golfer, the person would take a stance as shown in FIG. 3, with the foot locations 80 being selected so that the ball 76 is slightly forward of a location midway between the foot locations 80. Viewed form the left eye (for a right handed golfer) the side of the left eye should be directly in line with the black spot 27 and the ball 76 directly beneath. The shoulders of the person should be parallel to the cord. The putting stroke should be executed so that the putting head 78 does not hit the cord 26 on either the back stroke or the forward stroke. The putter face should be perpendicular to the cord 26, and the stroke should follow the cord 26 or on a path moving slightly inside of the cord 26.

After the practice strokes have been completed in the manner indicated above, where the intended path of travel 82 is along a straight line, the next step is to select a location on the green where the path from the putting location to the cup 22 has a significant break to one side or the other. In describing the process, relative to the breaking putt, the cord 26 will be considered as having two sections, namely an initial alignment section 84 which extends from the stabilizing post 14 to the alignment post 16, and a connecting section 86 extending from the alignment post 16 to the putting cup post 12.

To use the present invention when practicing a breaking putt, initially the putting cup post 12 is placed in the cup 22 as described above. Then the stabilizing post 14 is placed at a location which would enable the cord 26 to be in alignment with that of the initial alignment section 84 of the cord 26, when properly placed. Also, the stabilizing post 14 would be placed closer than 18 feet from the cup 22 to permit the cord to be extended along its two sections 84 and 86.

Figures 4A, 4B, 4C:
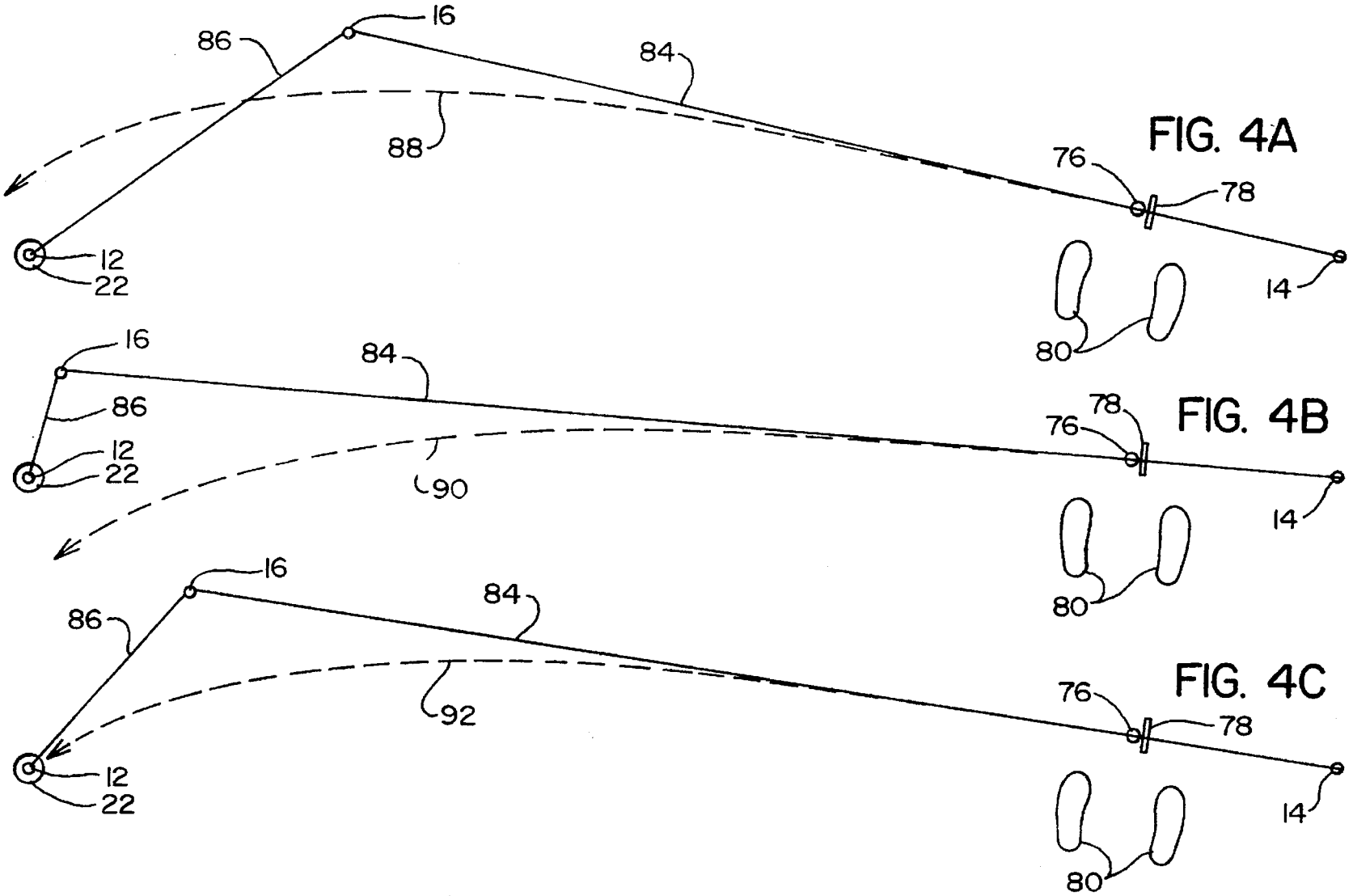
FIGS. 4A, 4B and 4C are top plan views similar to FIG. 3, showing the present invention being utilized in practicing putting on a laterally slope green surface where the ball follows a breaking path.

The method of using the present invention to practice a breaking putt will be first described in the situation where the putt is a relatively long putt, with the ball 76 being positioned under the fifteen foot black mark of the cord 26. This will be explained with reference to FIGS. 4A, 4B and 4C. In FIGS. 4A–C, the green surface 24 slants in a downward slant to the left (with reference to a person standing at the location of the ball 76 and looking toward the cup 22).

Initially, the alignment post or target post 16 (which can also be called the "alignment post") is positioned so that the initial alignment section 84 of the cord 26 is aligned with the desired path of the ball 76 immediately after being struck by the putting head 78. In the position of FIG. 4A, the curved path of the ball is shown in a broken line at 88. Let us assume for the moment that the ball 76 had been struck to impart the proper velocity to the ball 76 so that it will travel all the way to the cup 22, with its velocity diminishing to an appropriate level so that if the putt is missed, the ball 76 would travel only a short distance beyond the cup 22. As can be seen in FIG. 4A, the initial path of the ball 76 is from the ball location tangent to (and thus parallel to) the alignment section 84 of the cord 26. In this instance, the path 88 of the ball carries the ball to the right of the cup 22 (i.e. above the cup 22, with reference to the green surface 24).

Then an adjustment is made, and the alignment post is moved further to the left to the position as shown in FIG. 4B. The ball 76 is again placed below the fifteen foot black mark on the cord 26, and let us assume that the putting stroke is properly executed with the appropriate velocity imparted to the ball, and that the ball begins its path of travel following exactly the alignment of the initial alignment cord section 84. In this instance, as can be seen in FIG. 4B, the path of travel 90 of the ball carries it to the left of the cup (i.e. below the cup, relative to the slope of the green). Then the person makes the correction by moving the alignment post 16 so that the alignment of the initial alignment section 84 of the cord 26 is between the alignments shown in FIGS. 4A and 4B. Let us assume that the putting stroke is again executed properly. As can be seen in FIG. 4C, the ball 76 follows a path 92 in a curve terminating at the cup 22.

To analyze further the manner in which the present invention can be used for practicing the putt where there is a break to one side or the other, it should be recognized that the golfer goes through what might be termed a two step mental process. First, the golfer has to analyze the contour and speed of the green surface 24 so that both the proper putting path and also the desired velocity of the golf ball 76 would have to be determined. At this point to appreciate the task facing the golfer in practicing the breaking putt, it may be helpful to review what the originators consider to be the ten main fundamentals in executing a proper golf stroke. These are as follows:

1. The shoulders of the player should be parallel to the intended putting line. (As an aid in accomplishing this, the putter shaft can be placed horizontally across a person's shoulder, and the golfer would see if this is aligned with the cord 26.
2. The eyes should be positioned directly over the ball. (As an aid in determining this, the upper end of the shaft of the putter can be grasped between the thumb and forefinger, pendulum fashion, and by aligning this with the ball and with the left eye, by a right handed golfer, the proper head position can be ascertained.)
3. The stance is taken so that the ball is positioned slightly forward of the center location of the stance.
4. No head movement should occur during the putting stroke.
5. The path of the putter head should be directly along the alignment path or have a slight bend toward the inside of the intended target line.
6. The putter face should be at an angle that is perpendicular to the cord 26, which defines the intended line of impact.
7. The player should maintain a constant grip pressure throughout the putting stroke. (Preferably this is a moderately light pressure to permit a good feel and touch of the club.)
8. The right wrist angle should remain constant relative to the right forearm throughout the putting stroke (for a right handed golfer).
9. The stroke should be executed as a pendulum shoulder stroke about a center axis between the person's shoulders. (This will keep the putter low on both the backstroke and the forwardstroke.)
10. There should be an even tempo throughout the stroke—no hitting or slapping at the ball.

Although it may seem to be a rather elementary statement, it should be noted that these same fundamentals of executing a proper putting stroke have to be followed whether it is a straight putt directly toward the hole or a breaking putt. Thus, in practicing a breaking putt, the fact that the alignment of the initial alignment section 84 of the cord 26 is the same as the desired path of the ball immediately following the impact of the putter head 78 permits the golfer to have the proper alignment reference for executing the putting stroke properly.

Let us assume that the golfer is practicing a breaking putt and that the cord 26 is positioned as shown in FIG. 4A. Let us further assume that the player executes the putting stroke as indicated in FIG. 4A so that the putting path 88 leaves the ball 76 at approximately the location of the cup 22, but a moderate distance to the right thereof. This failure of the golf ball to be directed to the hole 22 could result from either of two things, namely the alignment section 84 of the cord 26 is too far to the right, or the person did not execute the putting stroke properly so that the initial path of the travel of the ball 76 was slightly to the right of the desired putting line. Let us assume for the moment that as the person executed the putting stroke in the situation of FIG. 4A, the person does notice that after impact with the putting head 78, the ball 76 was slightly off alignment to the right. The next step would be for the player to again execute the stroke more carefully so that the ball does begin its path of travel with the proper velocity and with the proper alignment. If after several tries it still happens that the ball ends up to the right of the cup 22, then the player can reasonably assume that he has simply selected an improper alignment for the initial cord section 84.

When the player is satisfied that the alignment section 84 is in the proper location, then that particular putting stroke can be practiced several times and the player will be able to direct his entire focus on the proper mechanics of the putting stroke itself, and not concern himself about the break of the ball.

Also, the amount of break in the ball's path will depend to some extent on the velocity which is transmitted to the ball by the impact of the putter. If the player is assured that the alignment of the cord section 84 is proper, then the player will also be able to focus more closely on the velocity of the putter head 78 during the putting stroke.

It has been found during development of the present invention that this method of practicing the putting stroke for breaking putts trains the player to be better able to focus on the proper execution of the putting stroke while still maintaining a focus on the proper alignment path.

In practicing the putt where the ball will follow a breaking path, the putt will be practiced at different distances from the cup. The present invention can be utilized as a very effective leaning tool, to calculate the desired angle of the alignment of the initial path of the ball immediately after being struck by the putter head. It is recognized that, as a general rule, for a given lateral slant on the green surface, the curvature or deviation from, the path of travel of the golf ball from the putting location to the cup will increase at a greater rate as the distance of the putting location from the cup increases. Therefore it is usually the case that for a given lateral slope of the green, as the length of the putt increases, the alignment angle of the initial path of the ball relative to a straight line drawn from the putting location to the cup will become greater.

Let us now take the situation where the person executing the putt is only three feet away from the cup. As the person moves farther from the cup 22 to practice the putting stroke, that person will have to make an estimate of the appropriate initial alignment path 84 of the cord 26. By going through the practice steps at different intervals (six feet, nine feet, twelve feet, etc.) with the player practicing the putt on a given lateral slope, the player will develop a better knack for refining his or her estimate of the proper alignment path 84 of the ball at the location of impact.

Also, it should be recognized that in practicing a breaking putt at relatively short distances from the cup, it may be desirable to wrap most of the cord 26 on to the upper part of the stabilizing post 14 so that the stabilizing post 14 is a short distance of the putting location. Then as the person moves further away from the cup, the person may wish to unwind more of the cord 26 and then reposition the alignment post 16 to obtain the proper alignment of the initial alignment cord section 84.

Another facet of the present invention is that it can be used as an analytical tool, and hence a practice tool, with regard to the curved path which the golf ball 76 might take in the latter part of its course of travel to the cup 22. This will be explained further with reference to FIGS. 5A through 5E.

One of the more difficult problems in ascertaining the amount of break when putting along a laterally slanting surface is the curved path which the ball will take toward the end of its path of travel toward the cup. The reason for this is that as the ball continues its curved path it departs at a more rapid rate away from the original alignment path along which it was struck from the putting location. If the player can more accurately predict the path that the ball might be taking in the final portion of its path of travel, it would be possible to more accurately predict a proper alignment of the initial alignment path.

This will be explained further with reference to FIG. 5A through 5E. The way the present invention could be used as an analytical tool is to take care not simply to place the alignment post 16 so that it properly defines the initial path of alignment form the post 14 to 16, but also to position the post 16 either further away or closer to the putting location 76 (but at the same alignment) so that the connecting cord portion 86 bears a relationship to the final portion of the path of travel of the ball. In this instance, we will assume that the player will want to locate the forward to rear location of the post 16 so that as the ball reaches its destination at the putting cup post 12, the path of the ball is exactly tangent to the alignment defined by the posts 12 and 16.

Figures 5A, 5B, 5C, 5D, 5E:
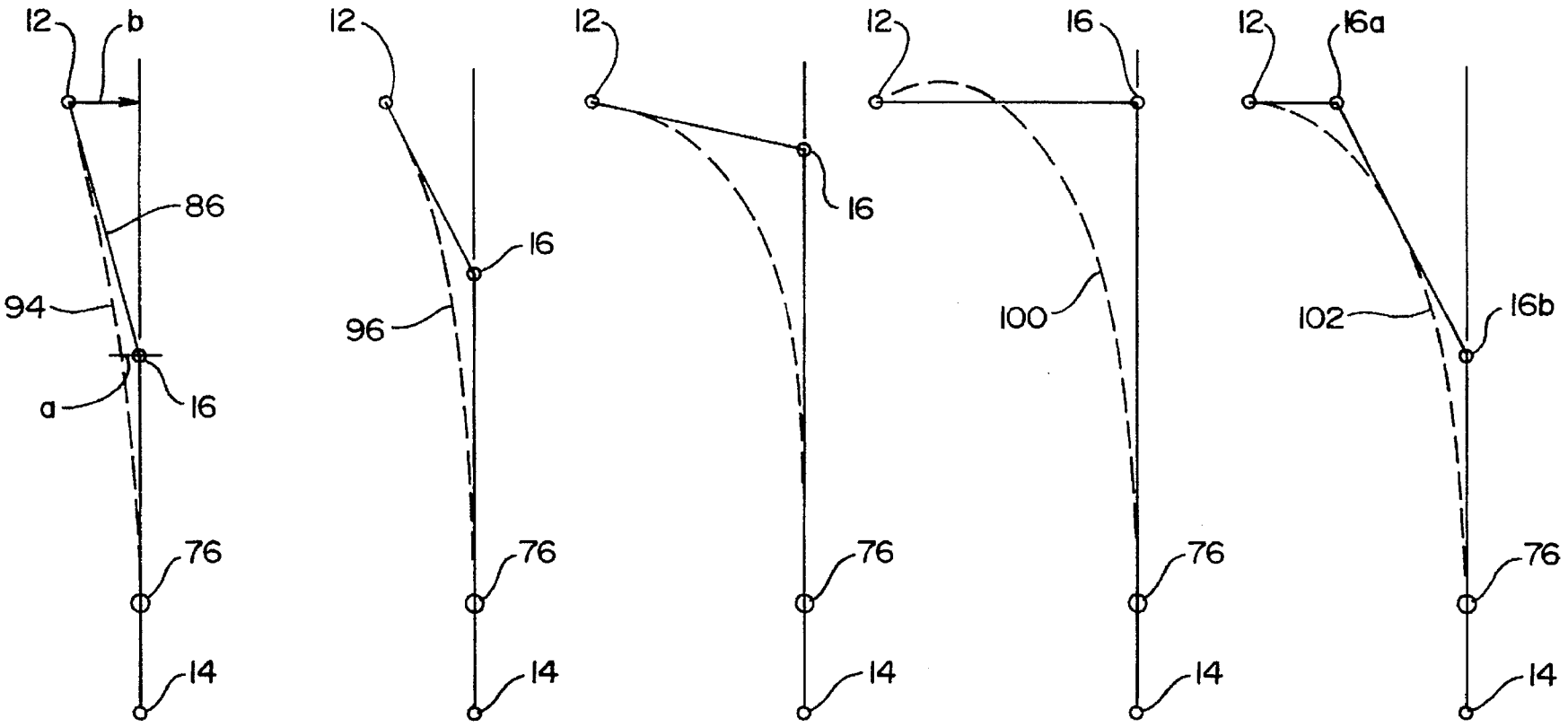
FIGS. 5A, 5B, 5C, 5D and 5E are semi-schematic top plan views, showing different ways the apparatus can be arranged to correspond to different types of breaking putts.

In each of FIGS. 5A through 5E, it will be assumed that the green surface 24 slopes downwardly to the left. In each of FIGS. 5A through 5E there are shown the locations of the putting cup post 12, the stabilizing post 14, and also the ball location 76. In FIGS. 5A through 5D, there is shown the placement of one aiming or alignment post 16. In FIG. 5E, there are shown two alignment posts 16*a* and 16*b*.

Let us begin our analysis by looking at FIG. 5A. For purposes of analysis it is assumed in FIG. 5A that the green surface 24 is a frictionless surface and that the green surface 24 is horizontal in a straightforward direction, but has a moderate lateral slant that is downward to the left. When the ball is struck at the location 76 in FIG. 5A, the force of gravity will impart an increasing lateral component of movement to the ball 76 which is equal to the square of the time period during which the ball is traveling. To explain this further, let it be assumed that in FIG. 5A there is a four second path of travel from the ball location at 76 to the putting cup post 12. Let it further be assumed that there is a four foot break from the initial path line extending from the post 14 to the post 16. As indicated above, the lateral component of travel of the ball perpendicular to the alignment path from post 14 to 16 would be equal to the square of the time during which the ball is traveling. Assuming that the forward velocity of the ball is constant (when there is neither surface friction nor friction from the air or other influences), when the ball passes the alignment post 16, it is spaced to the left a distance one foot at "a" from the alignment post 16. When the ball reaches the cup at the location of the post 12, the ball would be at a distance of four feet at "b" to the left of the alignment line extending from the post 14 to the post 16.

If the post 16 is placed almost exactly half way between the ball location 76 and the post 12 in FIG. 5A, the path of the ball as it reaches the putting cup post 12 will be exactly tangent to the second connecting line section 86.

The situation in FIG. 5A would be more similar to a situation where the putt in a forward direction is downhill and the green is fast so that the ball is traveling almost at a constant speed, and there is also a lateral downwardly slant to the left.

FIG. 5B represents a situation where the green surface is nearly horizontal in a forward direction or possibly even has a slight upward slant in a forward direction, and there is again the downward lateral slant to the left. In this instance also, the player in attempting to predict the curve of the path of the ball, places the alignment post 16 not only to define the proper alignment path of the ball location 76 to the alignment post 16 but also to ascertain the alignment from the post 16 to the post 12 so that it is tangent to the path of travel 96 of the ball as it reaches the location of the putting cup post 12. In this instance, since the forward velocity of the ball is decreasing as it comes nearer to the cup 12, and with the downward slope to the left being constant, the path 96 would be expected to have a relatively greater degree of curvature at its end path of travel in the end situation of FIG. 5A. This is reflected in the location of the post 16 being further away from the initial ball location at 76.

FIG. 5C shows a situation where the green surface 24 slopes upwardly from the putting location 76 in the general direction of the cup, and there is still the more or less constant lateral downward slope to the left. In this instance, the ball 76 is impacted with a greater velocity so that its initial path of travel is more rapid, and so that the deflection to the left would be diminished for the initial part of the path of travel. However, as the ball continues to travel up the forward slope, its velocity diminishes and the effect of gravity moving the ball in a lateral direction becomes more dominant. This could cause a further deflection to the left toward the putting cup post 12. In this instance, the golfer would be positioning the alignment post 16 yet further forwardly from the putting location at 26, so that the line from the post 16 to the post 12 still would be tangent to the path of travel of the ball as it comes to the cup location where the post 12 is located FIG. 5D represents a situation where there is, at least at the latter part of travel of the ball 76, a relatively steep upward slope in a forward direction. In this type of situation, it would even be possible for the ball as it is completing its path of travel toward the putting cup post 12 to have a rearward path component of travel so that it the path 100 moves forward of the location of the cup 12 and actually curves to the left and rearwardly to a slight extent to then arrive at the putting cup post 12. In this instance, the golfer may simply want to place the post 16 at the same forward location as the cup 12, and the path of the ball could be observed as it passes under and beyond the connecting cord section 86 and then to its destination at the putting cup post 12.

FIG. 5E illustrates yet another way of utilizing the present invention as a teaching and analytical tool. In this instance, there are provided two alignment posts 16*a* and 16*b*. These are placed at intermediate locations relative to the path 102 of the ball 76. In this instance, the golfer would be attempting to predict the curved path 102 and places the post 16*a* so that the line between the post 16*a* and 16*b* is tangent to the curved path 102 at an intermediate point of travel.

It would also be possible to use the two posts 16*a* and 16*b* to attempt to predict a path of travel where the ball is being putted over a green surface having a downward slant in one direction, and then in its latter path of travel the ball encounters a lateral slope in the opposite direction so it actually travels in something of an "S" shaped path. In this instance, the two posts 16*a* and 16*b* could be positioned so that the golfer would be attempting to predict the location tangent to the intermediate section of the cord 26 where the path of the golf ball is transitioning between the curve in one direction and then curving in the opposite direction.

The above situations are given by way of an example. Obviously, the posts 12, 14 and 16 could be arranged to give other indications or information of the predicted and actual path of travel.

Also, the present invention lends itself to performing a number of drills to improve the putting technique. Five of these are given by way of example.

1. The golfer sets up the apparatus 10 as indicated above, and then initially positions the ball an additional of three feet from the cup. Using the proper putting techniques as indicated above, the golfer then attempts three putts. This is repeated at locations six feet, nine feet, twelve feet and fifteen from the cup 22.
2. Next, the golfer again attempts three putts where the ball is positioned three feet away from the cup 22. However, in this instance the golfer holds the club only in the right hand. The golfer concentrates on maintaining a constant wrist angle throughout the putting stroke. This is also repeated by performing the three putts at six, nine, twelve and fifteen foot distances from the cup 22.
3. The putter again places the ball three feet from the cup 22 and makes three putts in succession, with the golfer's eyes closed during the putting stroke motion. In this instance, the golfer tries to "feel" the proper length and tempo of the putting stroke.
4. For this drill, the golfer combines drills 2 and 3 and attempts the five sets of three putts each with the eyes closed and only the right hand engaging the club, again keeping the angle of the right hand constant relative to the forearm.
5. The golfer again repeats the five sets of three putts each in a row, but he grips the club only with three fingers, with both thumbs and both forefingers removed from the putting grip. This helps to prevent the right wrist breakdown, and it also promotes a proper shoulder generated pendulum putting stroke.

Figure 6:
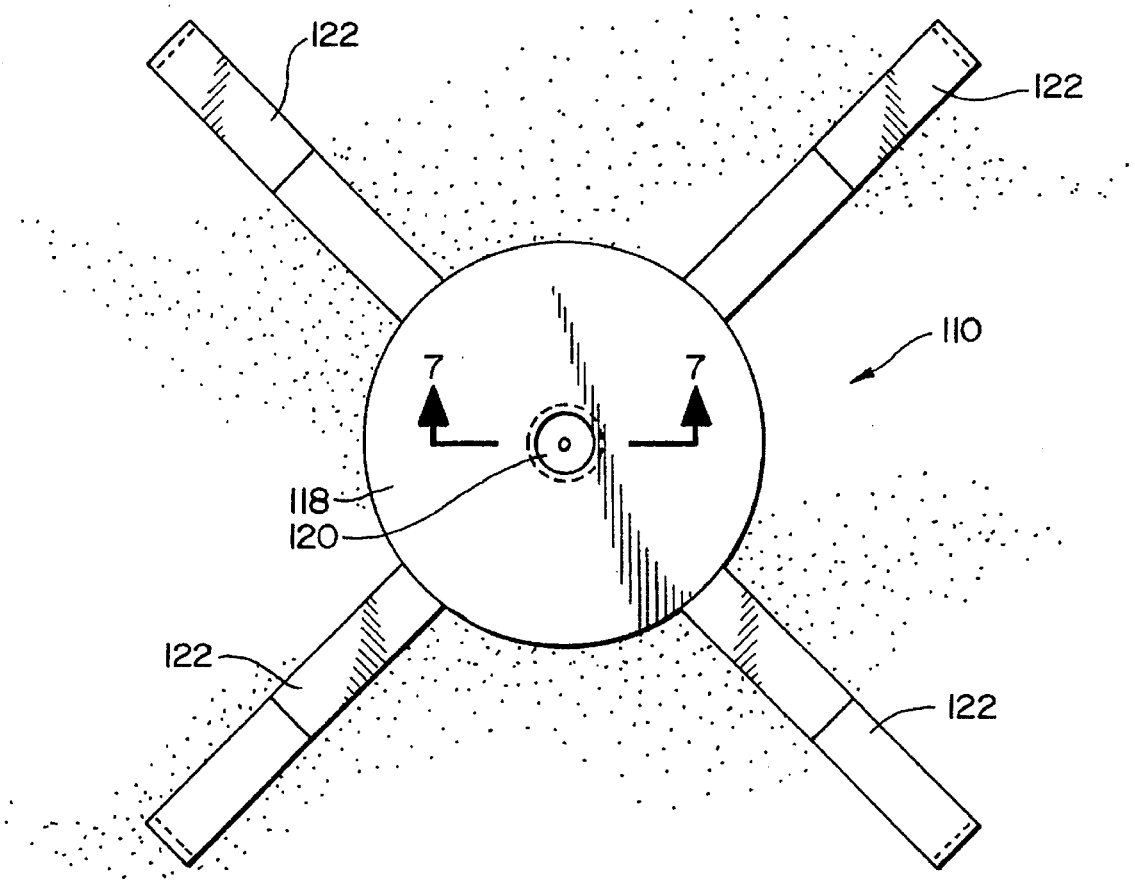
FIG. 6 is a top plan view looking down on the putting cup and showing a locating member.

FIG. 6 shows what can be termed a "target zone accessory" of the present invention, which is useful when the golfer is practicing rather long putts. This accessory shown in FIG. 6 is labeled 110, and this comprises a center mounting ring 112 having a cylindrical ring section 114 and a laterally extending annular flange 116 so that this ring member 112 can be positioned in the upper end of the putting cup 22. Attached to the upper surface of the mounting ring 112 is a circular piece of plastic sheet material 118 that has a center opening 120 surrounding the ring 116. Connected to and extending outwardly from the center circular sheet portion 118 are four radially extending arms 122, with each of these being about four feet in length. The end of each arm 122 is provided with a gripping member 124 which comprises a narrow flat plate member 125 having several downwardly extending teeth 126 to penetrate into the green surface 24.

The center member 118 and the arms 122 are made of thin flexible plastic sheet material, and are colored so as to be easily visible. For example, the circular center member 118 can be made yellow, the inner portions of the arms 122 colored red, while the outer portions of the arms 122 are colored blue.

In the operating position, the accessory 110 is spread out, and the mounting ring 112 is positioned in the cup 22 as shown in FIG. 7. Then the four arms 122 are stretched outwardly to take any wrinkles out of the center circular member 118, and the attaching members 124 are pressed downwardly so that the teeth 126 of each attaching member 124 penetrate a short distance into the green surface to hold the accessory 110 in place.

This accessory 110 can be used separately as a teaching aid. This is simply to provide a large target on which the player can focus when he is practicing rather long putts. Alternatively, this accessory 110 could be used in conjunction with the apparatus 10 of the present invention as described-previously herein.

It is obvious that various modification could be made to the present invention without departing from the basic teachings thereof.

What is claimed:

1. A method of practicing a putting stroke on a putting area where there is a putting surface and a putting cup location, said method comprising:

a. placing a putting cup post in a position to extend upwardly from the putting cup location;

b. positioning a stabilizing post on said putting surface at a location spaced from said putting cup location to extend upwardly above said putting surface;

c. positioning an alignment cord extending from said stabilizing post to said putting cup post in a manner that said cord is positioned above said putting surface, and at least an initial alignment portion of said cord is at a putting location, and is aligned with a target line which coincides with an initial portion of an intended putting line which extends from said putting location to said putting cup location;

d. placing a golf ball beneath said cord at said putting location; and e. executing a putting stroke to putt the ball from the putting location at least initially along the target line, visually utilizing the initial portion of the cord for alignment of the putting stroke.

2. The method as recited in claim 1, wherein a portion of the putting surface along said intended putting path is horizontally aligned relative to transverse alignment components along the length of the intended putting line, so that said intended putting line is a substantially straight putting line, and said cord is positioned to extend in a straight line from said putting location to said putting cup location.

3. The method as recited in claim 1, wherein the putting surface has a lateral slant relative to the intended putting line so that the intended putting line curves from the ball location toward the cup in a direction of downward lateral slant, and said cord is aligned so as to have an initial cord portion at the putting location aligned with the intended putting line at the putting location.

4. The method as recited in claim 3, wherein an alignment post is positioned on said putting surface at a target location positioned laterally of said putting line, and said initial cord portion extends from said putting location toward said alignment post.

5. The method as recited in claim 4, wherein said alignment post has at an upper portion thereof above the putting surface an alignment cord engaging portion, and said alignment cord is engaged with said cord engaging portion to properly position said cord above the putting surface.

6. The method as recited in claim 4, wherein each of said putting cup post, said stabilizing post and said alignment post has a lower mounting portion to position each of said posts at a pre-determined height above the putting surface, each of said posts having at an upper end thereof an alignment cord engaging means, said method further comprising extending said cord from each of said alignment cord engaging means of the three posts so that said alignment cord is at a proper pre-determined position above said putting surface.

7. The method as recited in claim 4, wherein at least one of said stabilizing post and said alignment post has at a lower end thereof a spike means arranged to extend into ground strata at the putting surface.

8. The method as recited in claim 4, further comprising selecting distance of the alignment post from the putting location so that a portion of the alignment cord extending from the alignment post to the putting cup post has a predetermined alignment relationship with a latter portion of a path of travel of the ball, whereby a person executing the stroke is able to correlate both an initial alignment portion of the alignment cord and a later portion of the alignment cord with the path of travel of the ball toward the putting cup location.

9. The method as recited in claim 1, wherein said alignment cord is initially wound on said stabilizing post at a winding location positioned on said stabilizing post, said cord extending from said stabilizing post at a predetermined distance above said putting surface to permit adequate vertical spacing for execution of a putting stroke.

10. The method as recited in claim 9, wherein said stabilizing post has at an upper end thereof a notch means to engage said alignment cord so as to retain said alignment cord at a fixed location on said stabilizing post.

11. The method as recited in claim 1, further comprising locating a target zone accessory means at said putting cup location, where said target zone accessory means comprises a planar sheet material having a central portion surrounding said putting cup location and a plurality of radially and outwardly extending arm portions, with ends of each arm portion having putting surface securing means to properly spread said accessory over said putting surface and around said putting location.

12. The method as recited in claim 1, wherein the putting surface has a lateral slant relative to the intended putting line so that the intended putting line curves from the ball location toward the cup in a direction of downward lateral slant, said method further comprising:

a. ascertaining a proposed intended putting line, and also a proposed target line which coincides with the initial portion of the proposed intended putting line;

b. positioning an alignment post at a target location spaced from said putting location toward said putting cup location, so that the alignment post is aligned with the intended target line;

c. locating the alignment cord so that the alignment cord extends above the putting surface from the stabilizing post to the alignment post, and from the alignment post to the putting cup post;

d. then executing the putting stroke to putt the ball initially along the target line;

e. in a situation where the ball after the executing of the putting stroke travels along a course out of alignment with the putting cup location, adjusting the position of the alignment post to correct the intended putting line.

13. The method as recited in claim 12, further comprising adjusting distance of the alignment post from the putting location so that a portion of the alignment cord extending from the alignment post to the putting cup post has a predetermined alignment relationship with a latter portion of a path of travel of the ball, whereby a person executing the stroke is able to correlate both an initial alignment portion of the alignment cord and a later portion of the alignment cord with the path of travel of the ball toward the putting cup location.

14. The method as recited in claim 1, wherein the putting surface has a lateral slant relative to the intended putting line so that the intended putting line curves from the ball location toward the cup in a direction of downward lateral slant, said method further comprising positioning a first alignment post at a location spaced from said ball location in alignment with said target line, then placing a second alignment post at a location intermediate said first alignment post and said putting cup post, and then extending said alignment cord from said stabilizing post to the first alignment post, thence to the second alignment post, and thence to the putting cup post to provide three alignment cord sections having an alignment relationship to the intended putting line.

15. An apparatus for practicing a putting stroke at a putting area where there is a putting surface and a putting cup location, said apparatus comprising:

a. a putting cup post having a base adapted to snugly fit in the socket in the bottom of a putting cup for enabling same to extend vertically upward from said putting cup location;

b. a stabilizing post adapted to be supported on said putting surface at a location spaced from said putting cup location to extend upwardly above said green surface;

c. an alignment cord arranged to be extended from said stabilizing post to said putting cup post in a manner that said cord is positioned above said putting position;

d. an alignment post adapted to be supported to extend upwardly from said putting surface and to be placed at an alignment location defining with said stabilizing post an initial alignment reference line which coincides with an initial portion of an intended putting line.

16. The apparatus as recited in claim 15, wherein said stabilizing post has at an upper portion thereof a cord retaining portion defining a winding area extending around said stabilizing post with said alignment cord being able to be wound around said winding area.

17. The apparatus as recited in claim 15, wherein said putting cup post has at a lower end thereof mounting means to interfit with a putting cup to position the putting cup post in an upright position from said putting cup.

18. The apparatus as recited in claim 15, wherein each of said putting cup posts, said stabilizing posts, and said alignment posts have an alignment cord engaging means, with each of the alignment cord engaging means being positioned along a lengthwise location of its related posts to be positioned a pre-determined desired distance above said putting surface.

19. The apparatus as recited in claim 15, wherein each of said alignment post and said stabilizing post have a spike means at a lower end thereof, with said spike means being adapted to be pushed into a ground surface below the putting surface, each of said stabilizing post and said alignment post have flange means presenting a downward facing locating surface adapted to engage the putting surface and properly locate its related post.

20. The apparatus as recited in claim 15, further comprising target zone accessory means, where said target zone accessory means comprises a planar sheet material having a central portion adapted to surround said putting cup location and a plurality of radially and outwardly extending arm portions, with ends of each arm portion having putting surface securing means to properly spread said accessory over said putting surface and around said putting location.

* * * * *